US011420307B2

(12) United States Patent
Gretz et al.

(10) Patent No.: US 11,420,307 B2
(45) Date of Patent: Aug. 23, 2022

(54) WRENCH FOR LUG NUTS AND METHOD OF MAKING

(71) Applicant: Caterpillar Inc., Peoria, IL (US)

(72) Inventors: Nickolas Jay Gretz, Lake in the Hills, IL (US); Scott Alan Thomas, Sarasota, FL (US)

(73) Assignee: Caterpillar Inc., Peoria, IL (US)

( * ) Notice: Subject to any disclaimer, the term of this patent is extended or adjusted under 35 U.S.C. 154(b) by 222 days.

(21) Appl. No.: 16/778,802

(22) Filed: Jan. 31, 2020

(65) Prior Publication Data

US 2021/0237233 A1 Aug. 5, 2021

(51) Int. Cl.
*B25B 13/50* (2006.01)

(52) U.S. Cl.
CPC ..... *B25B 13/5008* (2013.01)

(58) Field of Classification Search
CPC ..... B25B 13/48; B25B 13/5008; B25B 13/02; B25B 19/00; B25B 23/0021; B65G 7/00; B65G 7/12; F16L 7/252
USPC ..... 81/57.33, 120, 119
See application file for complete search history.

(56) References Cited

U.S. PATENT DOCUMENTS 1,763,353 A 6/1930 Heller
2,334,069 A 11/1943 Collins et al.
6,112,625 A * 9/2000 Turtle ..... B25B 23/0021 81/177.1
6,868,761 B2 3/2005 Stoick et al.
7,059,424 B2 6/2006 Neal et al.
D694,078 S 11/2013 Dumaine et al.
9,186,780 B2 11/2015 Dumaine et al.
2005/0217877 A1* 10/2005 Neal ..... B25B 21/02 173/104
2006/0150783 A1 7/2006 Thompson

FOREIGN PATENT DOCUMENTS

DE 1503088 A1 * 10/1969 ..... B25B 23/00
JP 6378580 B2 8/2018

OTHER PUBLICATIONS

Translation of DE1503088A1, retrieved from Espaceneton Oct. 29, 2021 (Year: 1969).*

* cited by examiner

*Primary Examiner* — Orlando E Aviles
*Assistant Examiner* — Thomas Raymond Rodgers
(74) *Attorney, Agent, or Firm* — Lee & Hayes, PLLC

(57) ABSTRACT

A wrench for tightening and loosening lug nuts may include a head disposed on a distal end of a handle. The head defines a curved inner surface facing an axis and an opening configured to receive a portion of a lug. One or more supports are formed on the curved inner surface, extending toward the axis. The supports are spaced from the opening and are configured to contact an outer surface of the lug with the portion of the lug received in the opening.

10 Claims, 6 Drawing Sheets

WRENCH FOR LUG NUTS AND METHOD OF MAKING

TECHNICAL FIELD

This patent disclosure relates generally to wrenches and, more particularly, to wrenches used to secure and remove nuts having lugs.

BACKGROUND

Pumping operations in industries like hydraulic fracking (or "fracking"), concrete pouring, well service, and others, can include pumping high viscosity fluids and/or fluids at high pressures. Such fluids may be transported via conduits, which can be subjected to high, cyclically-applied stresses. The conduits are typically made from pipe sections that are connected to one another using threaded nuts. These nuts typically include projecting wings or lugs that provide the ability to apply torque to tighten or loosen the nuts. For instance, a lug can provide one or more surfaces that a sledge hammer or a hydraulic hammer can strike to provide the significant impact loading or torque required to tighten or remove the nuts.

Traditionally, nuts for such pumping operations are known to have a limited service life due to the extreme conditions of their use and installation. Accordingly, such nuts may be removed and replaced with some frequency. In addition to, or as an alternative to, striking a strike surface, wrenches may also be used to assist in loosening and tightening such nuts. For instance, some conventional wrenches include a handle and one or more surfaces to engage a lug, e.g., with the goal of applying a force to rotate the nut.

U.S. Pat. No. 6,868,761 ("Stoick et al.") is one example of a known wrench. For example, Stoick et al. describes a breakaway torque wrench having a handle portion and an arcuate engagement portion. The arcuate engagement portion can include one or more engagement teeth that can engage an axial grooved fastener, such as a pipe, a nut, a bolt, a screw, or the like. While the wrench of Stoick et al. may represent an improvement over known wrench designs, it is still ineffective in improving all aspects of use and operation of wrenches, especially as applied to lug nuts having relatively larger lugs and/or tapered strike surfaces, as described herein.

SUMMARY

In an aspect of the present disclosure, a wrench can include a handle and a head disposed on the handle. The head may include a curved inner face and an outer face spaced from the curved inner face. The curved inner face may be at least partially curved about an axis, the curved inner face and the outer face may extend in a first direction parallel to the axis between a first edge and a second edge, the curved inner face and the outer face may extend in a second direction about the axis between a first end and a second end, and the handle may extend from the outer face. The wrench may also include an opening spaced from the handle and extending through the head from the inner face to the outer face, a first lateral support proximate the first edge and extending from the inner surface toward the axis, and a second lateral support proximate the second edge and extending from the inner surface toward the axis.

In another aspect of this disclosure, a wrench includes a curved head, a support, and a handle. The curved head defines an opening sized to receive a lug of a nut, is curved about an axis, and includes an inner face facing the axis. The support is spaced from the opening and extends from the inner face toward the axis. The support defines a contact surface spaced from the inner face in a radial direction toward the axis and is configured to contact an outer surface of the nut with the lug received in the opening. The handle is secured to the curved head at a location spaced from the opening and extends in a direction away from the axis. In yet another aspect of this disclosure, a wrench includes a handle and a head disposed on the handle. The head includes a curved inner face, an opening, a first lateral support, and a second lateral support. The curved inner face is curved about an axis and extends between a first edge and a second edge in a direction parallel to the axis. The opening extends through the head and is spaced from the handle in a circumferential dimension about the axis. The first lateral support is proximate the first edge and extends from the curved inner face toward the axis. The second lateral support is proximate the second edge and extends from the curved inner face toward the axis.

DETAILED DESCRIPTION

This disclosure relates to tools for use with pumping systems, and, more particularly, to wrenches for removing nuts used to connect segments of pipe or conduits such as those used in fracking, concrete pumping, well servicing, oil and gas, construction, and other industries. In embodiments described herein, wrenches may be particularly useful with a nut, such as the type that may be used on a hammer union for connecting two pipe segments that are used to transfer fluids under pressure during oilfield service or production operations. Such nuts may be referred to as "hammer nuts," and may be characterized as having a plurality of circumferentially-spaced lugs disposed about their outer surface or sidewall. In some examples, a wrench as described herein may engage one or more such lugs to assist an operator or technician with tightening and/or loosening the nut, e.g., using the wrench to apply a torque via one or more of the lugs. This disclosure is not limited to use with hammer nuts, and instead may be used with many types of nuts or other fasteners having lugs, as described herein. Wherever possible, the same reference numbers will be used through the drawings to refer to the same features.

Figure 1:
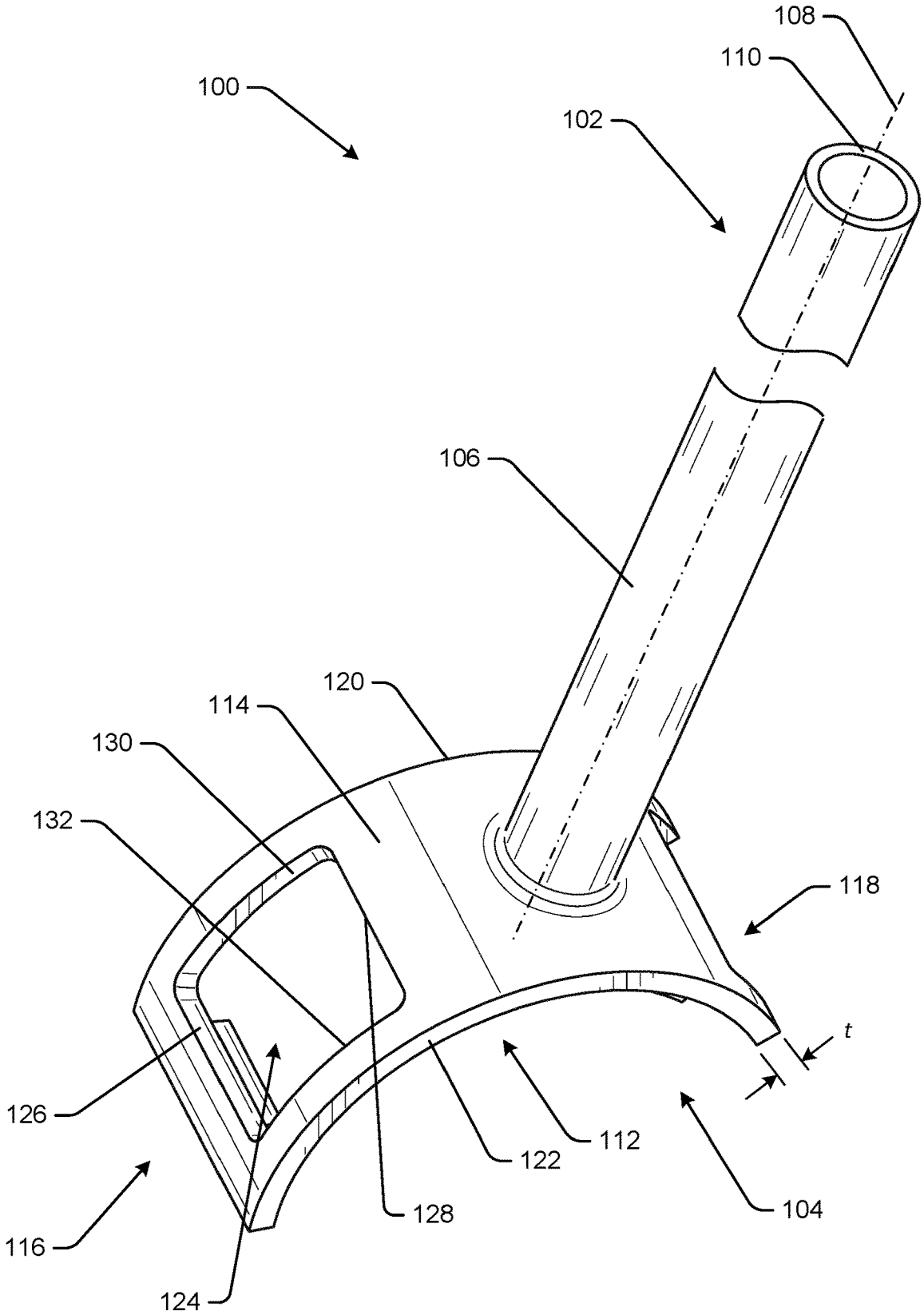
FIG. 1 is a first perspective view of a wrench in accordance with aspects of this disclosure.

FIG. 1 is a perspective view of an example wrench 100. The wrench 100 includes a handle 102 and a head 104 disposed at an end of the handle 102. The handle 102 is illustrated as having a generally cylindrical sidewall 106 extending generally along a handle axis 108. Although the sidewall 106 of the handle 102 is illustrated as being cylindrical, which may allow for the handle 102 to be made from readily available stock material, the sidewall 106 can be differently shaped. By way of non-limiting example, the sidewall 106 can include one or more generally planar surfaces and/or one or more generally arcuate surfaces. In addition, although the handle is illustrated as being hollow, the handle 102 may be solid in other embodiments. Moreover, although the handle 102 is illustrated as extending generally along the handle axis 108, in some implementations the handle 102 may include one or more arcuate and/or angled segments. As illustrated by the break in FIG. 1, a length of the handle 102, e.g., along the handle axis 108, can vary. Although the handle 102 is illustrated as having generally the same construction along its length, in some implementations a distal end 110 of the handle 102 can include one or more features, including features to aid an operator using the wrench 100. For example, and without limitation, the handle 102 may include a gripping surface, a coating, or the like, proximate the distal end 110.

The head 104 includes an inner face 112 (better seen in FIG. 2) and an opposite, outer face 114 spaced from the inner face 112 by a thickness t. The handle 102 extends from the outer face 114. The inner face 112 and the outer face 114 are generally curved surfaces, extending between a first end 116 and a second end 118 of the head 104. As a result of the curvature of the inner face 112 and the outer face 114, the first end 116 and the second end 118 extend generally away from the handle 102. As also illustrated in FIG. 1, the inner face 112 and the outer face 114 extend in a lateral direction between a first edge 120 and a second edge 122. Although the head 104 is illustrated such that the thickness t is substantially uniform, other implementations may have varied thicknesses and/or different contours. As described further herein, the inner face 112 may have an arc or contour between the first end 116 and the second end 118. For instance, the inner face 112 may be curved about an axis (such as an axis 302 discussed below, not shown in FIG. 1), however, the inner face 112 may have a substantially constant radius in a dimension parallel to that axis. The inner face 112 may be configured to generally mimic an outer surface of a nut to be removed using the wrench 100. Although FIG. 1 illustrates example characteristics of portions of the head 104, modifications may be made based on one or more factors, including aesthetics, manufacturing considerations, or the like. Further details of the functionality of the wrench 100 and, more specifically, the head 104, are detailed further herein.

As also illustrated in FIG. 1, the head 104 includes an opening 124 formed therethrough. The opening 124 is disposed proximate, but spaced from, the first end 116, is spaced from the handle 102, and is illustrated as being generally square with radiused corners. In part, the opening 124 is defined by a first opening edge 126 proximate the first end 116 and a second opening edge 128 spaced from the first opening edge 126, e.g., along an arcuate direction between the first end 116 and the second end 118. A width of the opening 124 is further defined by a third opening edge 130 and a fourth opening edge 132 spaced from the third opening edge 130. As shown, the third opening edge 130 is proximate, and generally parallel to, the first edge 120 of the head 104, and the fourth opening edge 132 is proximate, and generally parallel to, the second edge 122 of the head 104. The opening 124 may be sized to receive a lug of a nut to be tightened or loosened using the wrench 100. In examples, the first opening edge 126 and/or the second opening edge 128 may contact a surface of the lug, which may be a tapered surface, and a rotational force, e.g., a torque, may be applied to the nut by engaging the wrench 100 with the lug via the first opening edge 126 and/or the second opening edge 128.

Figure 2:
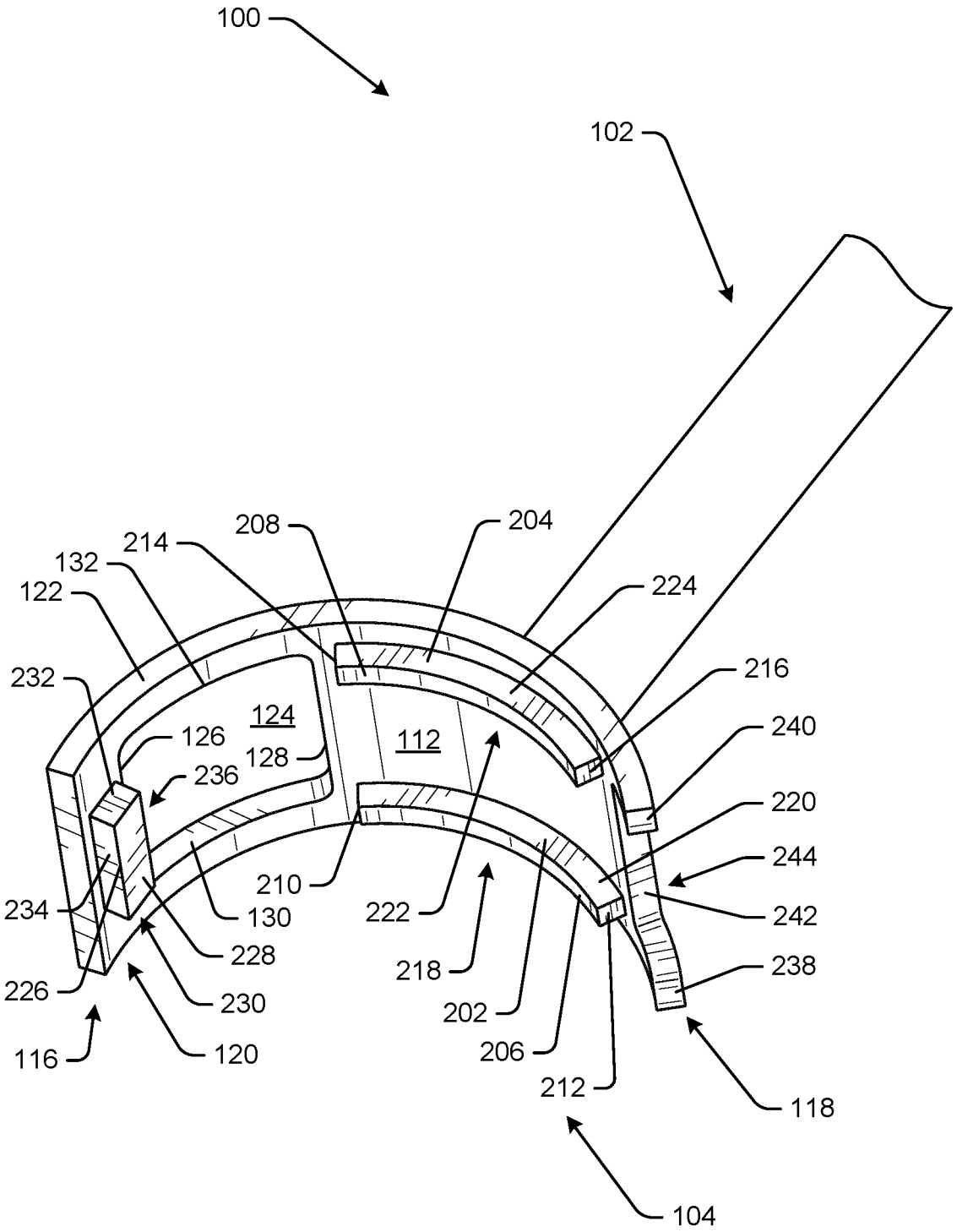
FIG. 2 is a second perspective view of the wrench of FIG. 1, in accordance with aspects of this disclosure.

FIG. 2 illustrates additional details of the wrench 100. More specifically, FIG. 2 shows aspects of the inner face 112 of the head 104 in more detail. For clarity, elements identified with a reference numeral in FIG. 1 are given the same reference numeral in FIG. 2.

FIG. 2 illustrates that the inner face 112 is a generally smooth, contoured surface. FIG. 2 also shows that the head 104 includes a first lateral support 202 and a second lateral support 204 extending from the inner face 112. As shown, assuming the inner face 112 is curved about an axis (not shown in FIG. 2), the first lateral support 202 and the second lateral support 204 extend from the inner face 112 generally toward the axis. As also illustrated, the first lateral support 202 defines a first contact surface 206 and the second lateral support 204 defines a second contact surface 208. As shown, because the first lateral support 202 and the second lateral support 204 extend radially inwardly from the inner face 112, the first contact surface 206 and the second contact surface 208 are spaced radially inwardly from the inner face 112. In the illustrated example, each of the first contact surface 206 and the second contact surface 208 is a generally continuous surface that is substantially parallel to the inner face 112.

As FIG. 2 also illustrates, the first lateral support 202 and the second lateral support 204 are generally elongate members. Specifically, the first lateral support 202 has a length extending along an arc from a first end 210 proximate the second opening edge 128 of the opening 124 to a second end 212 proximate the second end 118 of the head 104. Similarly, the second lateral support 204 has a length extending along an arc from a first end 214 proximate the second opening edge 128 of the opening 124 to a second end 216 proximate the second end 118. The first lateral support 202 also has a width defined between a first lateral edge 218 (generally hidden in FIG. 2) proximate the first edge 120 of the head 104 and a second lateral edge 220 spaced from the first lateral edge 218. Similarly, the second support 204 has a width defined between a third lateral edge 222 (generally hidden in FIG. 2) and a fourth lateral edge 224 spaced from the third lateral edge 222. In the illustrated example, the first lateral support 202 and the second lateral support 204 are substantial parallel to each other, and the first contact surface 206 and the second contact surface 208 may be generally similarly shaped and contoured. Moreover, the first contact surface 206 and the second contact surface 208 may be equally spaced from the inner face 112.

As illustrated, the contact surfaces 206, 208 and the lateral edges 218, 220, 222, 224 are formed such that each of the first lateral support 202 and the second lateral support 204 has a generally rectangular cross-section, e.g., normal to the arc of the respective contact surfaces 206, 208. However, other arrangements also are contemplated. As described further herein, the contact surfaces 206, 208 may be configured to contact an outer surface of a nut to be tightened or loosened using the wrench 100. The shape and/or size of the first lateral support 202 and/or the second lateral support 204 and/or the arrangement of the first contact surface 206 and/or the second contact surface 208 may be varied based on attributes of the nut. By way of non-limiting example when the outer surface of the nut (e.g., the portion of the nut to be contacted by one of the contact surfaces 206, 208) is contoured, the lateral supports 202, 204 may be configured based on such contour. For instance, if the outer surface of the nut is angled, the first contact surface 206 and/or the second contact surface 208 may be angled to more closely match the outer surface. In one example, the first lateral edge 218 of the first lateral support 202 may extend further from the inner face 112 than the second lateral edge 220 of the first lateral support 202 and/or the fourth lateral edge 224 of the second lateral support 204 may extend further from the inner face 112 than the third lateral edge 222. In this example, the first contact surface 206 and the second contact surface 208 may be tapered relative to each other, e.g., to at least partially face each other as in a "v" shape in which the legs of the "v" are spaced from each other.

Other configurations for the first contact surface 206 and/or the second contact surface 208 also are contemplated. For example, and without limitation, the first lateral support 202 and/or the second lateral support 204 may be at least partially arcuate in cross-section. For instance, the first contact surface 206 and/or the second contact surface 208 may be rounded surfaces. Without limitation, one or both of the first contact surface 206 and the second contact surface 208 may have a profile that includes one or more arcs and/or one or more straight segments. The first contact surface 206 and/or the second contact surface 208 may also include different finishes, e.g., to promote friction between the contact surfaces 206, 208 and the nut. By way of non-limiting example, one or both of the contact surfaces 206, 208 may be knurled, ribbed, or otherwise configured, e.g., through machining or other processes.

As also illustrated in FIG. 2, the head 104 optionally includes a support member 226 proximate the first end 116. The support member 226 may extend from the inner face 112, at a position on the inner face 112 between the first end 116 and the first opening edge 126 of the opening 124. The support member 226 defines a contact surface 228. As illustrated, the support member 226 may be an axial support member, e.g., having a length extending generally parallel to an axis about which the inner face 112 is curved. In more detail, the support member 226 has a length extending between a first support member end 230 (hidden in FIG. 2) and a second support member end 232 and a width, e.g., less than the length, extending between a first support member side 234 and a second support member side 236 (hidden in FIG. 2). The length and width are for example only and may be larger or smaller. In this example, the first support member end 230 is proximate (and generally parallel to) the first edge 120 of the head 104 and the second support member end 232 is proximate (and generally parallel to) the second edge 122 of the head 104. Accordingly, the length of the support member 226 may be generally perpendicular to the length of the first lateral support 202 and/or the second lateral support 204. As with the first contact surface 206 and the second contact surface 208, the contact surface 228 is shown as generally smooth surface parallel to the inner face 112, but such is not required. The contact surface 228 may have a different profile, different surface texture, or the like. Moreover, although the support member 226 is illustrated as a single member, in some examples, the support member 226 can be multiple members, e.g., spaced from each other. By way of non-limiting example, the support member 226 can include a first portion proximate the first edge 120 and a second portion, spaced from the first portion, proximate the second edge 120. For instance, the support member 226 can include laterally-spaced elements, similar to the first lateral support 202 and the second lateral support 204.

The head 104 also optionally includes, proximate the second end 118, a first lateral tab 238 and a second lateral tab 240. Inner surfaces of the first lateral tab 238 and of the second lateral tab 240, along with a notch surface 242 spaced from the end 118, define a notch 244. The notch surface 242 is spaced, e.g., in a circumferential direction along the arc of the inner face 112, from the opening 124. In some examples, a width of the notch, e.g., a distance between the first lateral tab 238 and the second lateral tab 240, may be the same as a distance between the third opening edge 130 and the fourth opening edge 132 of the opening 124. As described further herein, the notch 244 may be configured to receive a portion of a lug of a nut to be tightened or loosened using the wrench 100. For instance, the first lateral tab 238 and the second lateral tab 240 may extend along sides of a lug of a nut engaged by the wrench 100. In some instances, the distance of the notch surface 242 from the second opening edge 128 of the opening 124 may be determined based on characteristics of the nut with which the wrench 100 is to be used, e.g., such that the opening 124 engages with a first lug on a nut and the notch surface 242 engages with a second lug adjacent to the first lug. A length of the first lateral tab 238 and of the second lateral tab 240, e.g., generally in a direction along the arc of the inner face 112 and extending away from the opening 124, may vary.

Figure 3:
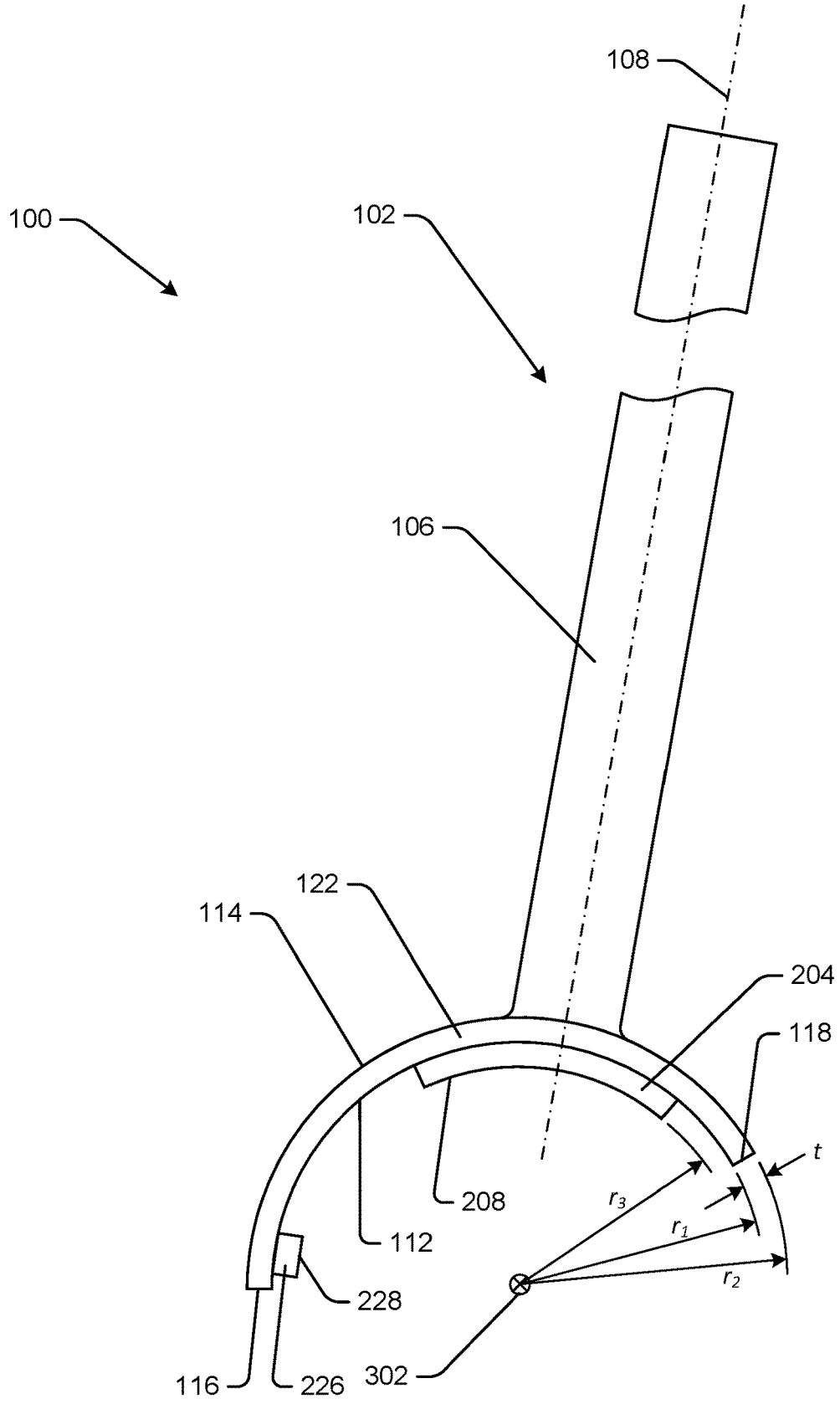
FIG. 3 is a side view of the wrench of FIG. 1, in accordance with aspects of this disclosure.

FIG. 3 shows the wrench 100 in profile. More specifically, FIG. 3 shows that the inner face 112 is generally curved about an axis 302. In the example, the inner face 112 is formed as a substantially constant first radius $r_1$ about the axis 302, and the outer face 114 is formed as a substantially constant second radius $r_2$ about the axis 302. Accordingly, in the illustrated example, the inner face 112 and the outer face 114 define a consistent thickness t along the length of the head 104, e.g., along the arc of the inner face 112 and/or of the outer face 114. Moreover, and as will be appreciated from FIG. 3, the thickness is also constant in a direction parallel to the axis 302, e.g., in a direction extending from the first edge 120 (not visible or labelled in FIG. 3) to the second edge 122. Although the example illustrates the inner face 112 and the outer face 114 has having a constant radius, the inner face 112 and/or the outer face 114 may be shaped otherwise. For example, the inner face 112 and/or the outer face 114 may be made up of a number of discrete arcuate segments having different radii of curvature and/or one or more generally straight segments, e.g., approximating an arc. As will also be appreciated, in some examples the contour of the outer face 114 may be less important to the functionality of the wrench 100, and thus may take other shapes.

As also shown in this example, the first and second contact surfaces (of which only the second contact surface 208 is visible) and the support member contact surface 228 are spaced radially inwardly, e.g., toward the axis 302, from the inner face 112. As described above, the contact surfaces 206, 208, 228 may be generally parallel to the inner face 112, although such is not required. The contact surfaces 206, 208, 228 may also be equally spaced from the inner face 112, although such also is not required. As detailed further herein, the contact surfaces 206, 208, 228 may be configured to contact an outer surface of a nut to be tightened or loosened using the wrench 100. Thus, the configuration and/or arrangement of the contact surfaces 206, 208, 228 may be based on a design of a nut with which the wrench 100 is to be used. In examples, the contour of the inner face 112 may be of less importance than the relative positions and/or orientations of the contact surfaces 206, 208, 228. For instance, when an outer surface of a nut to be engaged by the wrench 100 is generally cylindrical, it may be beneficial for the contact surfaces 206, 208, 228 to be disposed at a third radius $r_3$, as shown in FIG. 3. However, when the outer surface of the nut is contoured (as in the example of FIG. 4, discussed below), the contact surfaces 206, 208, 228 may be differently formed, contoured, and/or spaced. Also in the example of FIG. 3, the handle axis 108 may be normal to, and intersect, the axis 302. As a result, a user may apply a force to the handle 102 that causes a torque about the axis 302.

Figure 4:
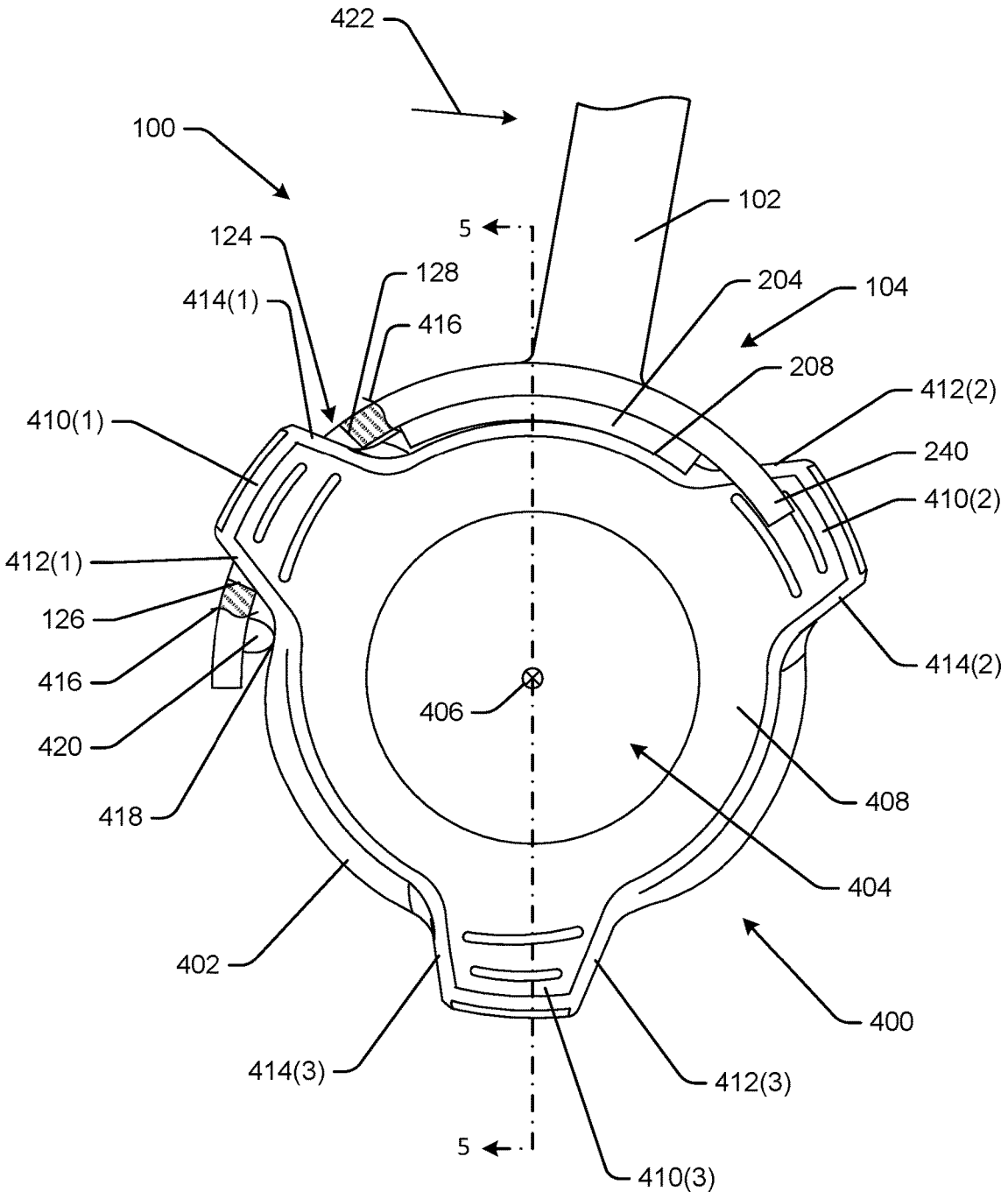
FIG. 4 is a view of the wrench of FIG. 1 interacting with a lug nut in accordance with aspects of this disclosure.

FIG. 4 is useful to illustrate functionality of the wrench 100 in more detail. More specifically, FIG. 4 is a profile view of the wrench similar to that of FIG. 3, but including a nut 400. The nut 400 is an example nut with which the wrench 100 can be used and has a generally hollow cylindrical shape that includes an outer surface 402 and a central opening 404 disposed about a central axis 406. The nut 400 may have an axial height generally along the central axis 406 from a first face 408 to a second face (not shown in FIG. 4).

A first lug 410(1), a second lug 410(2), and a third lug 410(3) (herein, the first lug 410(1), the second lug 410(2), and the third lug 410(3) may be referred to, collectively, as "lugs 410") are spaced circumferentially about the nut 400 and extend radially outwardly from the outer surface 402. The first lug 410(1) includes a first strike surface 412(1) circumferentially spaced from a second strike surface 414(1); the second lug 410(2) includes a first strike surface 412(2) circumferentially spaced from a second strike surface 414(2); and the third lug 410(3) includes a first strike surface 412(3) circumferentially spaced from a second strike surface 414(3). Herein, the first strike surface 412(1), the first strike surface 412(2), and the first strike surface 412(3) may be referred to, collectively, as the first strike surfaces 412, and the second strike surface 414(1), the second strike surface 414(2), and the second strike surface 414(3) may be referred to, collectively, as the second strike surfaces 414. As also illustrated in FIG. 4, each of the first strike surfaces 412 may be angled relative to its respective one of the second strike surfaces 414. Moreover, the first strike surfaces 412 and the second strike surfaces 414 may be angled relative to a radial dimension extending from the central axis 406. Although FIG. 4 illustrates three lugs 410, the nut 400 may include more or fewer lugs 410, and such lug(s) can be equally or differently spaced about the circumference of the nut 400.

In conventional use, an operator may strike one of the first strike surfaces 412 or one of the second strike surfaces 414, e.g., using a hammer or the like, to impart a rotation on the nut 400. In the illustration of FIG. 4, striking one of the first strike surfaces 412 will result in a clockwise rotation, which may tighten the nut 400, e.g., on a threaded conduit (not shown). Conversely, striking one of the second strike surfaces 414 will result in a counterclockwise rotation, which may loosen the nut 400. Similarly, the wrench 100 may be used to assist in imparting a rotation on the nut 400, e.g., by applying a force at one or more of the first strike surfaces 414 and/or one or more of the second strike surfaces 414, as follows.

As illustrated in FIG. 4, the wrench 100 is arranged such that the head 104 engages the nut 400 and the handle 102 extends outwardly from the head 104. In at least some examples, the axis 302 (not shown in FIG. 4) about which the head 104 is arced may be coincident with, or parallel to, the central axis 406 of the nut 400. A portion of the head 104 is cut away, at section lines 416, to demonstrate that the opening 124 receives the first lug 410(1). Specifically, with the wrench 100 positioned as shown, the first strike surface 412(1) is positioned proximate the first opening edge 126 and the second strike surface 414(1) is positioned proximate the second opening edge 128. The first lug 410(1) extends partially through the opening 124. As also illustrated, the first contact surface 206 of the first lateral support 202 contacts the outer surface 402 between the first lug 410(1) and the second lug 410(2). Although not visible in FIG. 4, the second contact surface 208 of the second lateral support 204 may also contact the outer surface 402, e.g., at a position spaced along a direction parallel to the central axis 406. (This contact is shown in more detail in FIG. 5, discussed below.)

FIG. 4 also illustrates that a contact surface 418 of a support member 420 may also contact the outer surface 402, e.g., on a side of the first lug 410(1) opposite the second lug 410(2). In this example, the contact surface 418 and the support member 420 may be variations of the contact surface 228 and the support member 226, respectively, illustrated in FIGS. 2 and 3 and discussed above. More specifically, the contact surface 418 may be an arcuate or rounded surface, instead of the generally planar contact surface 228. As noted above, the support member 226 and the contact surface 228 may have any number of variations or modifications, and FIG. 4 illustrates one such example. As also illustrated in FIG. 4, the second lateral tab 240 extends over a portion of the second lug 410(2). Although not visible in FIG. 4, the first lateral tab 238 similarly extends along the axially-spaced opposite side of the second lug 410(2). The notch surface 242 (not visible in FIG. 4) may contact the first strike surface 412(2) of the second lug 410(2). Stated differently, the second lug 410(2) is partially received in the notch 244.

With the wrench 100 engaged with the nut 400 as shown in FIG. 4, an operator can tighten the nut by applying a force to the handle 102 generally in a direction indicated by arrow 422, e.g., generally tangential to an arc about the central axis 406. Under this force, the first opening edge 126 contacts and transmits the applied force to the first strike surface 412(1). In some instances, the force applied along the arrow 422 may also be transferred to the first strike surface 412(2) of the second lug 410(2). More specifically, although not visible in FIG. 4, the notch surface 242 may be spaced, e.g., circumferentially, from the first opening edge 126 such that the notch surface 242 contacts the first strike surface 412(2) of the second lug 410(2). Stated differently, the notch surface 242 and the first opening edge may have the same spacing as adjacent lugs 410.

In the illustrated arrangement, a force on the handle 102 in the direction opposite the arrow 422 may cause the second opening edge 128 to contact the second strike surface 414(1) of the first lug 410(1), thereby causing the nut 400 to rotate counterclockwise. Such may result in loosening of the nut 400, for example. Alternatively, to move the nut in the counterclockwise direction, an operator may rotate the wrench 180-degrees from the illustrated arrangement, e.g., about the handle axis 108, and re-engage the wrench 100 with the nut 400 such that the opening 124 is placed over a first of the lugs 410 and the notch 244 is disposed to partially receive the lug that is adjacent in the counterclockwise direction, in the orientation illustrated in FIG. 4. As noted above, this arrangement may promote both the first opening edge 126 and the notch surface 242 engaging the lugs 410.

Modifications to the example of FIG. 4 also are contemplated. For instance, the first opening edge 126 and the second opening edge 128 are illustrated generally as being along a radius extending from the central axis 406 (or from the axis 302 shown in FIG. 3). However, such is not required. By way of non-limiting example, the first opening edge 126 and/or the second opening edge 128 (and/or the notch surface 242 not illustrated in FIG. 4) may be angled relative to this radial direction. For instance, one or more of these edges/surfaces may be angled to approximate an angle of the first strike surfaces 412 and/or the second strike surfaces 414. Also in examples, one or more of the first opening edge 126, the second opening edge 128 and/or the notch surface 242 may be differently profiled, e.g., arcuate, stepped, or the like, and/or may include one or more surface features, e.g., knurling, a surface finish, or the like. Such features may enhance an interface of the respective edges/surfaces with surfaces of the nut 400.

Figure 5:
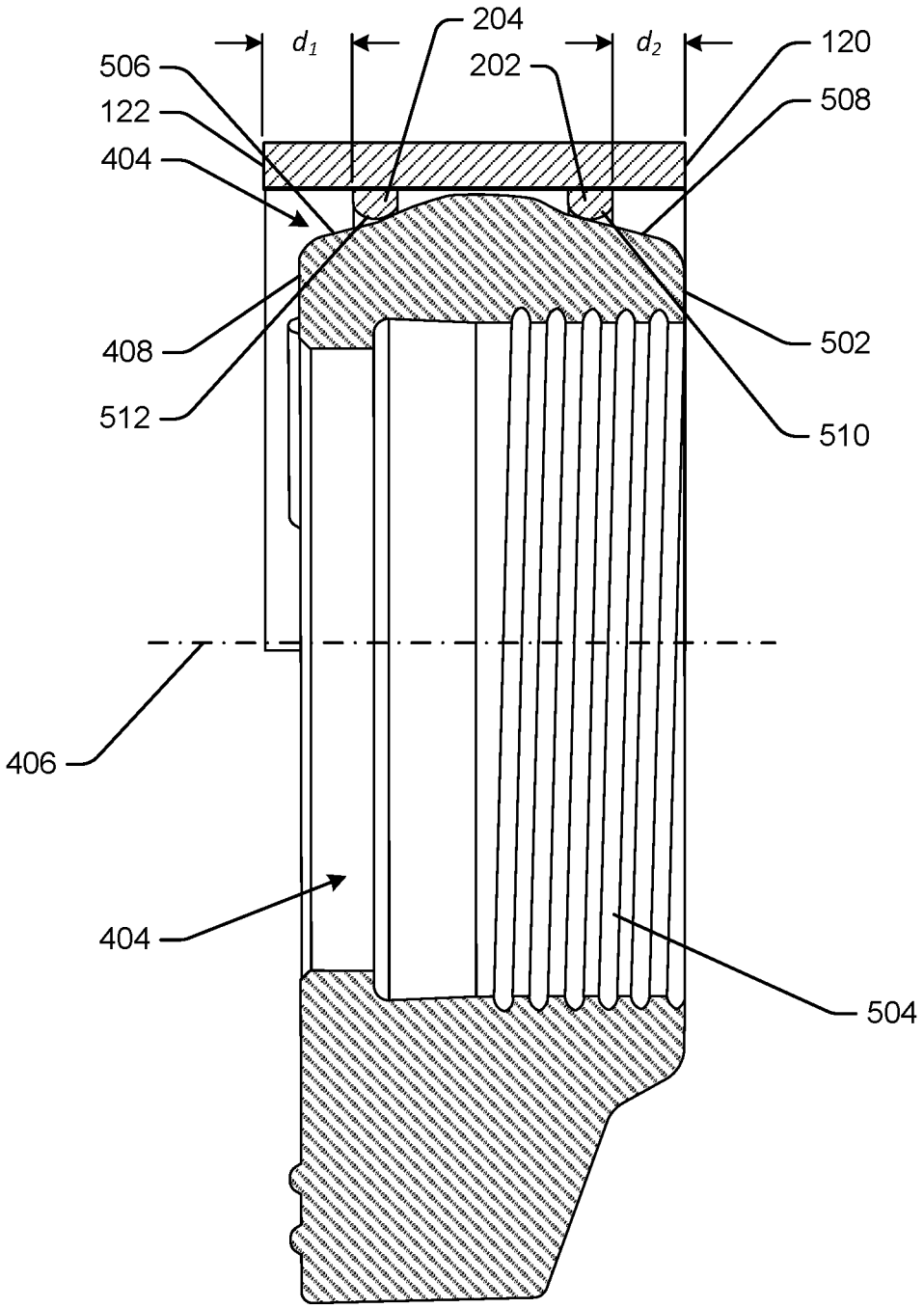
FIG. 5 is a section view of the wrench of FIG. 1, taken along the section line 5-5 in FIG. 4, in accordance with aspects of this disclosure.

FIG. 5 is a section view taken along section line 5-5 in FIG. 4 and illustrates additional details of the engagement of the wrench 100 with the nut 400. More specifically, FIG. 5 demonstrates the nut 400 in profile, including the first face 408 and a second face 502 spaced from the first face 408 along the central axis 406. FIG. 4 also shows one or more threads 504 in the central opening 404. As also illustrated in FIG. 4, the outer surface 402 is contoured between the first face 408 and the second face 502. Specifically, the outer surface 402 includes a first contoured surface 506 proximate the first face 408 and a second contoured surface 508 proximate the second face 502. The first contoured surface 506 is generally closer to the central axis 406 proximate the first face 408 than at positions farther from the first face 408. Similarly, the second contoured surface 508 is generally closer to the central axis 406 proximate the second face 502 than at positions farther from the second face 502.

As shown in more detail, the first lateral support 202 and the second lateral support 204 are configured to provide contact with the second contoured surface 508 and the first contoured surface 506, respectively. Specifically, the first lateral support 202 includes a first contact surface 510 that contacts the second contoured surface 508 and the second lateral support 204 includes a second contact surface 512 that contacts the first contoured surface 506. In this example, the first contact surface 510 and the second contact surface 512 may be the first contact surface 206 and the second contact surface 208, respectively. For example, the first contact surface 510 and the second contact surface 512 have an arcuate or rounded profile, different from the generally square profile provided by the first contact surface 206 and the second contact surface 208. The first contact surface 510 and the second contact surface 512 are provided generally as another example, and additional examples also are contemplated. For instance, and without limitation, the first contact surface 510 and/or the second contact surface 512 may be angled, e.g., to correspond to an angle of the second contoured surface 508 and/or the first contoured surface 506. Moreover, although the first lateral support 202 and the second lateral support 204 are illustrated as being substantially identical, they may have different profiles.

In FIG. 5, the first contact surface 510 and the second contact surface 512 are configured to contact different portions of the outer surface 402. In some examples, including the illustrated example, the first lateral support 202 and the second lateral support 204 may be positioned relative to each other and/or relative to other features of the head 104 to promote this contact. For instance, FIG. 5 illustrates that the first lateral support 202 is a first distance $d_1$ from the first edge 120 of the head 104 and that the second lateral support 204 is a second distance $d_2$ from the second edge 122 of the head 104. In the illustration, the first distance is larger than the second distance. In examples, the first distance $d_1$ and/or the second distance $d_2$ may be varied based on the contour of the outer surface 402. For instance, when the first contoured surface 506 and the second contoured surface 508 are spaced equally from the inner surface 112, e.g., along a radial direction, the distances $d_1$, $d_2$ may be configured to maintain the wrench 100 such that the axis 302 about which the inner face 112 is curved is generally parallel to, or coincident with, the central axis 406 of the nut 400. Maintaining the wrench 100 in this orientation on the nut 400 can improve transfer of the force applied to the handle 102 to the lugs of the nut 400, for example, and ease operation.

In the illustrated example, the first distance $d_1$ and the second distance $d_2$ are varied such that the first contact surface 510 and the second contact surface 512 maintain a proper orientation of the wrench 100 on the nut 400. In other examples, the distance of the contact surfaces 510, 512 from the inner face 112 may be varied to provide this proper orientation. In the example illustrated in FIG. 5 the first contoured surface 506 has a different profile (e.g., steeper) than the second contoured surface 508. Consider an example in which the second lateral support 204 is relatively closer to the second edge 122, that is, the first distance $d_1$ is smaller than illustrated. In this example, the first distance $d_1$ may be the same as the second distance $d_2$, although the distances may be other than equal. Continuing the example, moving the second lateral support 204 to the left in FIG. 5 will result in a gap between the first contoured surface 506 and the second contact surface 512 (assuming the same orientation of the wrench 100 and the nut 400). In use, the wrench 100 may rock or pivot, e.g., between a first position like that shown (in which the first contact surface 510 contacts the second contoured surface 508) and a second position (not shown, in which the second contact surface 512 contacts the first contoured surface 506). To prevent this relative movement, the second lateral support 204 may extend farther from the inner face 112 than the first lateral support 202, e.g., such that the second contact surface 512 is closer to the axis 302 than the first contact surface 510. In the context of FIG. 3, the radial dimension $r_3$ may be different for the first contact surface 510 than for the second contact surface 512.

Figure 6:
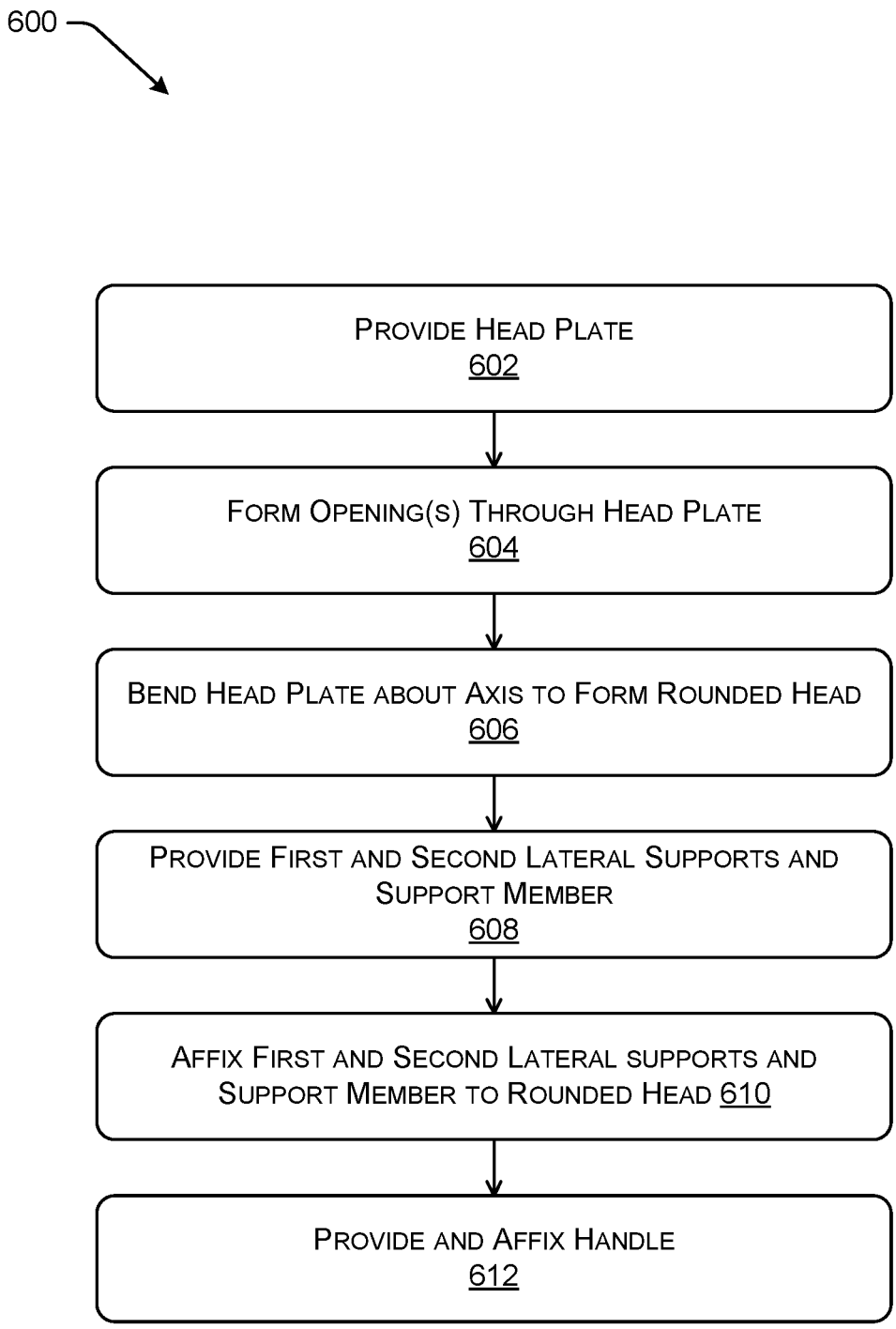
FIG. 6 is a flow chart illustrating an example process for manufacturing a wrench, such as the wrench of FIG. 1.

FIG. 6 illustrates an example method 600 of manufacturing the wrench 100. In some examples, the wrench may be simpler and more cost effective to produce than conventional designs, and the method 600 shows some example steps for achieving such benefits.

Specifically, at an operation 602, the method 600 includes providing a head plate. The head 104 may be formed from a flat plate having the thickness t and generally extending laterally between the first edge 120 and the second edge 122 and longitudinally between the first end 116 and the second end 118. In some examples, the head plate can be stamped, cut or otherwise formed from a larger sheet and/or from stock. For example, the head plate can be metal, e.g., steel, iron, and/or alloys.

At an operation 604, the method 600 includes forming one or more openings through the head plate. For example, the head 104 is illustrated as having the opening 124 formed therethrough, and the operation 604 can include forming the opening 124, e.g., by cutting, stamping, or other known fabricating processes. The operation 604 can also include forming the notch 244 proximate the second end 118. In some implementations, the operation 604 can also include forming an opening (not shown) through the head plate for receiving the handle 102. In some examples a through-hole can be sized to receive an end of the handle 102, although in other instances a bore or other feature that does not extend completely through the head 104 can be formed as a part of the operation 604. As described in examples throughout this disclosure, the openings formed during the operation 604 may include the creation of tapered and/or or otherwise angled edges, e.g., to match the contours and/or angles of a nut 400 with which the wrench 100 is to be used. By way of non-limiting example, the opening 124 may be formed such that the first opening edge 126 and the second opening edge 128 are angled relative to each other (and are other than at 90-degrees relative to the inner face 112 and the outer face 114)

At an operation 606, the method 600 includes bending the head plate about an axis to form the rounded head. For example, the head 104 can be formed by bending the head plate about the axis 302. In at least some examples, the head 104 may have a generally constant radius about the axis 302, although such may not be required. The bending of the operation 606 may be accomplished using known metal fabricating techniques.

At an operation 608, the method 600 can include providing first and second lateral supports and the support member. For example, the first and second lateral supports can be the first lateral support 202 and the second lateral support 204 and the support member can be the support member 226. In examples, one or more of the lateral supports and/or the support member may not be required. The first lateral support 202 and the second lateral support can be curved, generally elongate members, e.g., with the curvature matching that of the inner face 112 of the head 104. The support member 226 can be a cuboid, as shown, or any other three-dimensional shape, as described herein. In some instances, a face of the support member 226 can be arcuate, e.g., to match the curvature of the inner face 112.

At an operation 610, the method 600 can include affixing the first and second lateral supports and the support member to the rounded head. For example, the first lateral support 202 and the second lateral support 204 may be positioned proximate the first edge 120 and the second edge 122, respectively, and the support member 226 can be positioned proximate the first end 116 of the head 104. The first lateral support 202, the second lateral support 204 and the support member 226 may then be affixed to the head 104 at these positions, e.g., via welding or the like. In some examples, tack welding, fillet welding, and/or other welding techniques can be used to affix the components. In some instances, the first lateral support 202 and the second lateral support 204 may be welded along their entire length proximate the first edge 120 and the second edge 122, e.g., along the first lateral edge 218 and the fourth lateral edge 224. However, the first lateral support 202 and the second lateral support may be only spot-welded along the second lateral edge 220 and the third lateral edge 222. Reducing the amount of welding along the second lateral edge 220 and/or the third lateral edge 222 may reduce interference of the weld material with the outer surface 402 of the nut 400 when the wrench 100 is engaged with the nut 400.

At an operation 612, the method 600 can also include providing and affixing the handle. For example, the handle 102 can be an elongate, cylindrical component, and can be welded to the outer face 114. As noted above, the operation 604 can also include forming an opening through the head plate to receive an end of the handle 102 and the operation 612 may include placing the handle 102 in such opening prior to affixing the handle 102 via welding or the like.

Although FIG. 6 illustrates the operations in a certain order, the method 600 is not limited to the illustrated order. For instance, and without limitation, the lateral supports 202, 204, the support member 226 and/or the handle 102 may be affixed to the head plate prior to bending the head 104. Moreover, the method 600 may also include additional operations. For instance, and by way of non-limiting example, the method 600 can include one or more finishing operations, e.g., to provide surface finishes (e.g., on contact surfaces), grip surfaces (e.g., on the handle), or the like. Other operations may also or alternatively be performed to provide features, functionality, and/or modifications detailed further herein.

The method 600 may allow for improved efficiency when manufacturing a wrench. For instance, because the head plate, the lateral supports 202, 204, the support member 226, and the handle can be made from conventional stock, e.g., plate or roll stock, the cost to manufacture the components may be less than in previous methods in which expensive forged and/or cast components are required. Similarly, the majority of the components can be affixed using conventional welding techniques, including tack or fillet welding, with minimal or no additional tooling. Moreover, by modifying aspects of the opening 124, the lateral supports 202, 204, the support member 226, and/or other components, the wrench 100 can be customized based on attributes of the nut 400 (or of different nuts). For instance, the positions and/or profiles of the contact surfaces 206, 208, 228 may be varied, as described herein.

INDUSTRIAL APPLICABILITY

The present disclosure provides an improved wrench, which may be used in applications such as gas, oil, construction, and fracking applications. The wrench may be particularly useful in tightening and loosening nuts in high pressure applications and/or with fluids containing abrasive particles. The disclosed wrench may provide superior engagement with one or more lugs of a nut, for better force transmission to the nut, thereby being more effective to tighten/loosen the nut.

According to some examples, a wrench 100, may include an arcuate or rounded head 104 having an opening 124 sized to receive at least a apportion of a lug 410 of a nut 400. For instance, the nut 400 may include plurality of spaced lugs 410 having angled (relative to a radial direction) strike surfaces 412, 414. The wrench 100 can also include a notch 244 for receiving a second lug 410, e.g., adjacent to the lug 410 received in the opening 124. The wrench 100 can also include lateral supports 202, 204 defining contact surfaces 206, 208 for contacting an outer surface 402 of the nut 400. In examples, the wrench 100 can also include a support member 234 proximate an end of the head 104 defining a contact surface 228, also for contacting the outer surface 402 of the nut. The contact surfaces 206, 208, 228 may provide an improved coupling of the wrench 100 to the nut 400, for example.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A wrench comprising:

a handle; and a head disposed on the handle, the head comprising:

a curved inner face and an outer face spaced from the curved inner face, wherein:

the curved inner face is at least partially curved about an axis, the curved inner face and the outer face extend in a first direction parallel to the axis between a first edge and a second edge;

the curved inner face and the outer face extend in a second direction about the axis between a first end and a second end, and the handle is secured to the outer face;

an opening spaced from the handle and extending through the head from the curved inner face to the outer face;

a first lateral support proximate the first edge and extending from the curved inner face toward the axis, the first lateral support being spaced from the first edge by a first distance; and a second lateral support proximate the second edge and extending from the curved inner face toward the axis, the second lateral support being spaced from the second edge by a second distance different from the first distance, the first lateral support defining a first contact surface for contacting a nut at a first location and the second lateral support defining a second contact surface for contacting the nut at a second location.

2. The wrench of claim 1 wherein the curved inner face defines a substantially constant radius about the axis.

3. The wrench of claim 1 wherein the first lateral support defines the first contact surface at the first distance along the first direction from the first edge and the second lateral support defines the second contact surface at the second distance along the first direction from the second edge.

4. The wrench of claim 3 wherein the first contact surface is a first height from the curved inner face and the second contact surface is a second height from the curved inner face.

5. The wrench of claim 1 further comprising a support member proximate the first end, the support member extending from the curved inner face toward the axis and defining a third contact surface.

6. The wrench of claim 5 wherein the third contact surface comprises one of a substantially planar contact surface or a contoured contact surface.

7. A wrench comprising:

a handle; and a head disposed on the handle, the head comprising:

a curved inner face curved about an axis and extending between a first edge and a second edge in a direction parallel to the axis;

a curved outer face to which the handle is coupled, the curved outer face being spaced from the curved inner face by a thickness, and the thickness being substantially constant between the first edge and the second edge and between opposite ends of the head spaced circumferentially about the axis;

an opening extending through the head and spaced from the handle in a circumferential dimension about the axis;

a first lateral support proximate the first edge and extending from the curved inner face toward the axis, the first lateral support being spaced from the first edge by a first distance; and a second lateral support proximate the second edge and extending from the curved inner face toward the axis, the second lateral support being spaced from the second edge by a second distance different from the first distance.

8. The wrench of claim 7, wherein the curved inner face has a substantially constant radius about the axis.

9. The wrench of claim 7 wherein the first lateral support defines a first contact surface proximate the first edge and the second lateral support defines a second contact surface proximate the second edge.

10. The wrench of claim 7, wherein the curved inner face of the head extends in the circumferential dimension about the axis from a first end of the opposite ends to a second end of the opposite ends, the opening is spaced proximate the first end and the handle is spaced proximate the second end, the head further comprising:

an axial support member proximate the second end and extending from the curved inner face toward the axis.

* * * * *